US009321577B2

(12) United States Patent
Obrist et al.

(10) Patent No.: US 9,321,577 B2
(45) Date of Patent: Apr. 26, 2016

(54) APPARATUS FOR THE STORAGE AND METERING OF A PLURALITY OF COMPONENTS

(75) Inventors: Manfred Obrist, Lustenau (AT); Josef Ettlin, Eichberg (CH); Sasan Habibi-Naini, Rikon (CH)

(73) Assignee: SULZER MIXPAC AG, Haag (CH)

( * ) Notice: Subject to any disclaimer, the term of this patent is extended or adjusted under 35 U.S.C. 154(b) by 1256 days.

(21) Appl. No.: 12/804,307

(22) Filed: Jul. 19, 2010

(65) Prior Publication Data

US 2011/0017771 A1 Jan. 27, 2011

(30) Foreign Application Priority Data

Jul. 23, 2009 (EP) ..... 09166235

(51) Int. Cl.

| | |
|---|---|
| ***B67D 1/00*** | (2006.01) |
| ***B65D 81/32*** | (2006.01) |
| ***B01F 5/06*** | (2006.01) |
| ***B01F 15/02*** | (2006.01) |

(52) U.S. Cl.

CPC ..... *B65D 81/3266* (2013.01); *B01F 5/0641* (2013.01); *B01F 15/0203* (2013.01); *B01F 15/0256* (2013.01)

(58) Field of Classification Search

CPC ..... B65D 81/3266; B01F 5/0641; B01F 15/0203; B01F 15/0256

USPC ..... 206/219, 222, 497, 532, 538, 828; 215/DIG. 8; 222/80, 81, 83, 83.5, 85, 222/94, 145.5, 145.6, 541.2; 366/130; 433/90; 604/87, 191, 416

See application file for complete search history.

(56) References Cited

U.S. PATENT DOCUMENTS

| | | | | |
|---|---|---|---|---|
| 4,952,068 | A * | 8/1990 | Flint | 366/337 |
| 5,114,004 | A * | 5/1992 | Isono et al. | 206/222 |
| 5,242,082 | A * | 9/1993 | Giannuzzi | 222/82 |
| 6,260,735 | B1 * | 7/2001 | Fuquen | 222/94 |
| 6,287,612 | B1 * | 9/2001 | Mandava et al. | 426/120 |
| 7,934,864 | B2 * | 5/2011 | Heusser et al. | 366/130 |
| 2002/0122685 | A1 * | 9/2002 | Lee et al. | 401/118 |
| 2003/0019883 | A1 * | 1/2003 | De Laforcade | 222/1 |
| 2003/0075561 | A1 * | 4/2003 | Pieri | 222/94 |
| 2005/0007871 | A1 * | 1/2005 | Angeletta | 366/130 |
| 2006/0283761 | A1 * | 12/2006 | Gherdan et al. | 206/532 |
| 2007/0269253 | A1 * | 11/2007 | Caro | 401/132 |
| 2008/0123465 | A1 * | 5/2008 | Heusser et al. | 366/130 |

(Continued)

FOREIGN PATENT DOCUMENTS

| | | |
|---|---|---|
| CH | 398 453 A | 3/1966 |
| CH | 674 717 A5 | 7/1990 |

(Continued)

*Primary Examiner* — Patrick M Buechner

(74) *Attorney, Agent, or Firm* — Francis C. Hand; Carella, Byrne et al.

(57) ABSTRACT

An apparatus for the storage of a plurality of components designed for joint use includes two separate oppositely disposed storage regions for the respective components with a separating film between the storage regions. Each storage region is connected to separate discharge passages which open into a common mixing passage A kinking site is arranged between the storage regions and the first and second discharge passages and parting elements are provided to cut through the film to open each respective storage region to a respective discharge passage upon flexing of the apparatus about the kinking site.

12 Claims, 8 Drawing Sheets

(56) References Cited

U.S. PATENT DOCUMENTS

Figure 1:
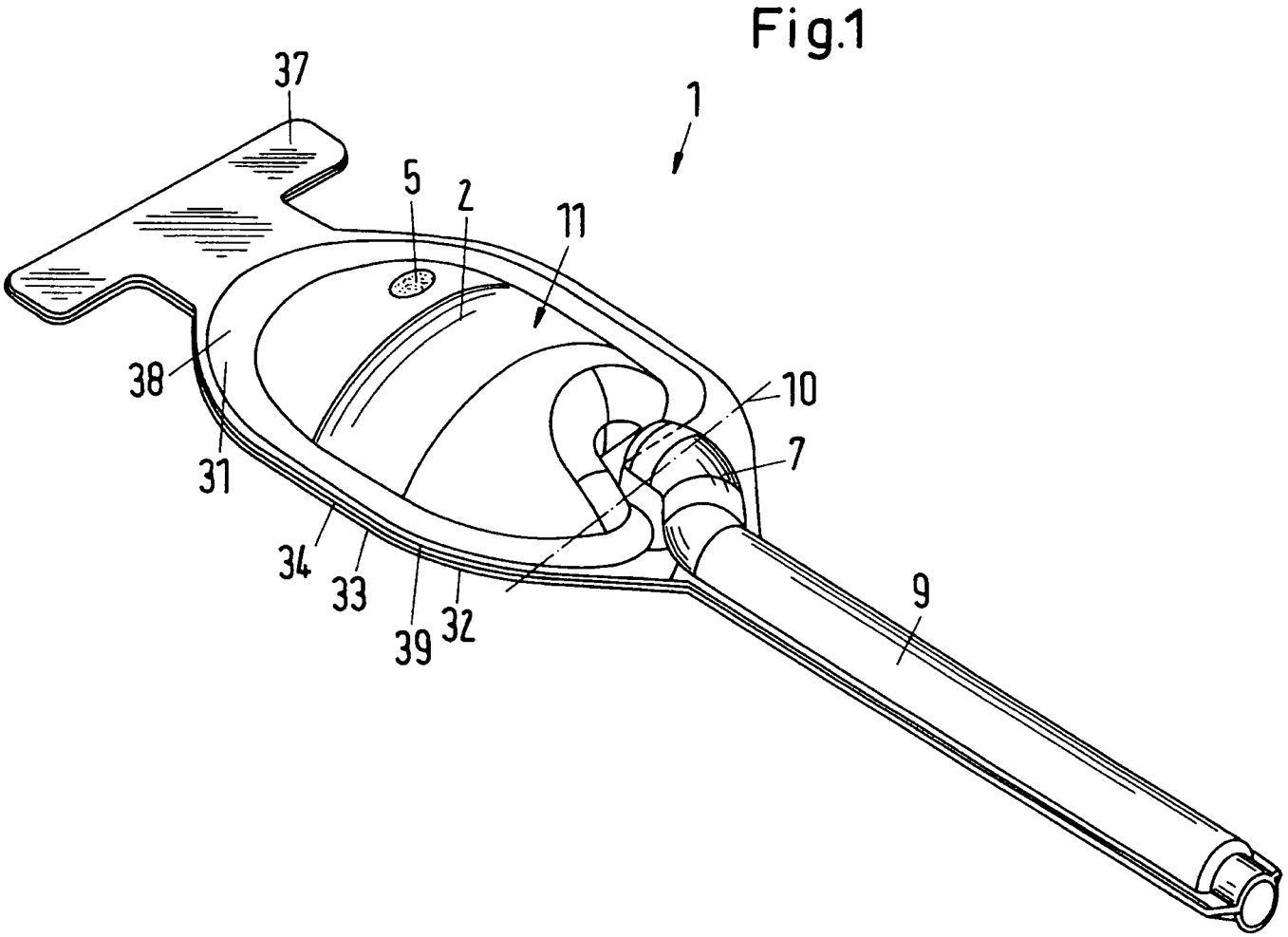

| | | | | |
|---|---|---|---|---|
| 2008/0173565 | A1* | 7/2008 | Staub et al. | 206/532 |
| 2008/0223875 | A1* | 9/2008 | LaFlamme et al. | 222/135 |
| 2009/0114677 | A1* | 5/2009 | Stuart | 222/94 |
| 2011/0017775 | A1* | 1/2011 | Obrist | 222/94 |

FOREIGN PATENT DOCUMENTS

| | | | | |
|---|---|---|---|---|
| DE | 42 22 049 | A1 | 1/1994 | |
| EP | 1 947028 | A | 7/2008 | |
| WO | WO 0009415 | A2 * | 2/2000 | B65D 81/32 |
| WO | WO 2006/079413 | A | 8/2006 | |

* cited by examiner

APPARATUS FOR THE STORAGE AND METERING OF A PLURALITY OF COMPONENTS

This invention relates to an apparatus for the storage and metering of a plurality of components. More particularly, this invention relates to an apparatus for the storage and metering of a plurality of components which should be mixed with one another directly before use and should be supplied to an application in a mixed state.

Such apparatus are used, for example, for the storage of the individual components of a multi-component adhesive. A further application can be found in the food industry or for the packaging of medical preparations. All these apparatus have the common feature that the individual components are stored in separate storage regions, which can be closed until use.

If such apparatus are designed for single use they are also commonly referred to blister packaging. A chamber of a blister packaging for a liquid or powdery filling material is made as a rule from a deep drawn film and a sealing film which sealingly closes the filling material off from the environment in the storage state.

In various applications for foodstuff, cosmetics, pharmaceutical products, dental products, sealing compounds or adhesives, a plurality of components are stored separately before they are supplied to their intended use. The components are, however, used together, usually in a mixed state. Apparatus are used for this purpose such as are described, for example, in EP 1 947 028 A2.

The apparatus in accordance with EP 1 947 028 A2 includes a first storage region for the reception of a first component and a second storage region for the reception of a second component, with the two storage regions being arranged substantially above one another. Each storage region includes an indentation which can be tightly closed by a cover. The cover can be sealed with the indentation while forming a seam and the storage regions are connectable outside the seam by a connection element, with it in particular being a weld connection. The covers are made from the same material which is designed as a film, in particular as a deep drawn film. To improve the chemical or physical properties, such as the resistance to chemicals, multi-layer films such as aluminum composite films can also be used in which the surface to be welded is made from a plastic which can be easily welded.

A mixing element can adjoin the two storage regions such as is shown for a multi-component film container known from DE 20 2005 001 203 U1. The storage regions open at one side into a mixing region which is separated from the storage regions such that each component is stored separately in the storage region provided for it as long as it is being stored.

In the first embodiment shown in DE 20 2005 001 203 U1, separating webs are arranged between the storage regions. Each storage region is formed as a half-shell which is filled with a component and which is adjoined by a groove-shaped recess into which a mixing element can be inserted. The separating webs are pressed apart at a preset point by the components being discharged to open a passage to the groove-shaped recess which forms the dispensing passage.

In accordance with other embodiments of DE 20 2005 001 203 U1, an opening punch is attached to the mixer to establish a connection between the storage regions and the mixing element by parting a partition wall which enables the dispensing of the components.

For this purpose, the mixing element is displaced relative to the housing by means of a plunger.

The force to be exerted onto the plunger for the pressing apart of the separating webs or for the parting of the partition wall is comparatively large since the separating webs or partition wall have to have a sufficiently large wall thickness to protect the filling material from blows and damage on transport and storage and to prevent their discharge.

The plunger is accordingly small for an apparatus designed for single use so that it requires some skill to open the passage to the storage regions reliably when the components of the filling material should be mixed and dispensed.

As an alternative, it is also shown in DE 20 2005 001 203 U1 to provide opening punches which lead into a passage which conducts the corresponding component on to the mixing element. If a compressive force is exerted onto the opening punch, a film located between the two storage regions is pierced by the opening punch. The corresponding component of the filling material can subsequently move through the passage to the mixing element if, for example, the storage region is pressed together, for example, by application of a compressive force. Since in this case only the film is pierced, the force to be applied is admittedly smaller, but the opening of the passages therefore requires some skill because the two passages are opened after one another.

However, this means that a component can already be present in the passage and in the mixing element before the opening of the passage for the second component is concluded. Skill and experience is thus also required for the actuation of this opening punch.

It is also known to part a partition wall by displacing the mixing element together with the housing of the mixing element. In accordance with this solution, however, the mixing element must be manufactured together with its housing as a separate component. The two components have to be sealingly connected by connection element such that the components are guided to the mixing element and through the mixing element, but a discharge of the components at another point, in particular at the connection between the component which includes the mixing element and its housing, and at the storage regions is reliably avoided. This solution is thus too complex and too expensive for an apparatus for single use.

It is therefore the object of the invention to provide a cost-effective apparatus which is simple to operate and which can be reliably opened by a simple movement while using small opening forces.

This object is satisfied by the apparatus for the storage of a plurality of components which are designed for joint use. The apparatus includes a first storage region for the reception of a first component and a second storage region for the reception of a second component. The first storage region is arranged opposite the second storage region. This means that the first storage region is located above or beneath the second storage region. The first storage region is separated from the second storage region by a film so that the first storage region extends on a first side of the film and the second storage region extends on a second side of the film. The first storage region can be connected to a first discharge passage. The second storage region can be connected to a second discharge passage. The first discharge passage and the second discharge passage open into a common mixing passage. A line-shaped kinking site is arranged between the first and second storage regions and the first and second discharge passages. Under a line-shaped kinking site it is intended that the kinking site has the shape of a line. The line can be of straight or curved shape.

A mixing element can be arranged in the mixing passage to mix the components homogeneously prior to their use. The mixing element can in particular be formed as a static mixing element.

In accordance with a preferred embodiment, the first storage region and the first discharge passage are arranged on the first side of the film, the second storage region and the second discharge passage are arranged on the second side of the film. This arrangement is particularly advantageous since the filling materials can be removed from both storage regions simultaneously. For this purpose, pressure can be exerted manually onto the two storage regions in that they are pressed together by hand. Alternatively to this, the apparatus can be clamped into a discharge aid by means of which pressure can be applied to the storage regions. The flexible envelope of the storage regions yields under this pressure. The volume of the storage region decreases continuously as the dispensing continues until the filling material has completely left the storage regions. The wall of the storage region can likewise include an enveloping film or a plurality of enveloping films.

At least one of the first and second discharge passages can have a base. This base is in one part with the discharge passages in accordance with a preferred embodiment and can even form a unit with the mixing element adjoining the discharge passages. The base has an end facing the corresponding storage regions, with the kinking site being formed by the end of the base.

At least one of the discharge passages advantageously has a parting element which extends beyond the kinking site in the direction of the storage region associated with the corresponding discharge passage. The film which sealingly holds the first component in the first storage region and sealingly holds the second component in the second storage region can be parted means of the parting element.

The parting element advantageously contains a cut-out. This cut-out ensures that the parted film does not block the corresponding discharge passage.

The parting element advantageously has a first and a second arm which extends beyond the kinking site in the direction of the storage region associated with the discharge passage. Alternatively to this, the storage region can also have an arm which extends beyond the kinking site in the direction of the corresponding discharge passage. This arm is connected to the discharge passage such that, for the case that it starts from the discharge passage, on a movement of the discharge passage, it also executes its movement. This means that a movement of the arm takes place by movement of the discharge passage. If the discharge passage is moved about the kinking site relative to the storage regions by means of a rotational movement, the corresponding arm of the parting element comes into contact with the film and starts to exert a compressive force onto the film. The film can be weakened or scored by this compressive force so that the path for the corresponding component is released in the direction of the discharge passage.

The arm in accordance with any one of the preceding embodiments can for this purpose in particular have a cutting edge facing the film. The cutting edge is in particular designed such that a slit-shaped opening can be introduced into the film using a small compressive force after contact of the cutting edge with the film. The cutting edge is in particular arranged at or in the proximity of the tip of the parting element, that is at the point at which the two arms come together.

At least one of each of the first and second arms which are arranged adjacent to one another form a tip at which a cutting edge facing the film is arranged. If the cutting edge extends over at least a part of the side of the arm facing the film and if this cutting edge runs together, in particular in point form, at the tip, a particularly small compressive force is required to part the film since the total compressive force can be concentrated in one point and thus a small deflection of the passage is required to effect a piercing of the film.

In accordance with a particularly preferred embodiment, the cut-out is surrounded by the tip, by the corresponding first and second arms and by the base of the corresponding discharge passage. The largest possible opening hereby results so that it can reliably be avoided that a part of the parted film closes this opening again and the dispensing of one of the components would be delayed at the cost of the other component and accordingly the mixing ratio of the two components would be changed in an inadmissible manner.

The discharge passage includes a base as well as a first wall and a second wall which extends from the base. The wall at the discharge passage prevents a film which closes the discharge passage as part of the assembly from lying on the base.

At least one of the arms can adjoin the corresponding first or second walls. The arm can in particular be formed by at least one of the first and second walls. The arm and the walls can be components of a mixing element produced in one piece. Such a mixing element can in particular be manufactured as a plastic component in an injection molding process.

The surface disposed opposite the tip can have a rounded portion. Such a rounded portion is in particular advantageous when the parting element is surrounded by a film which may not be damaged on the storage of the apparatus. Since the storage regions are surrounded by an enveloping film, it is possible also to envelop the discharge passages and the mixing element with this enveloping film in one workstep. This enveloping film must, however, therefore be able to be deformed under finger pressure, that is be flexible. If this enveloping film moves onto an edge, it is parted, as is desired on contact of the parting element with the film between the storage regions, but is in no way desired in the case of the enveloping film since the corresponding components can be discharged by the created leak.

The film can be kinked along the kinking site so that the film can be parted by the arm and/or the parting element in the kinked state.

The parting element is arranged such that the film can be parted on the first side by means of the parting element when the angle between a film closing the storage regions and at least one of the bases of the first and second discharge passages is less than 180°.

Alternatively or additionally, the parting element is arranged such that the film can be parted the second side by means of the parting element when the angle between a film closing the storage regions and at least one of the bases of the first and second discharge passages is greater than 180°.

The film can be parted by means of the parting element at the side of the oppositely disposed storage region when the angle between the film on the first side of the kinking site, which contains the storage region and the second side of the kinking site, which contains the discharge passage, is greater than 180°.

In accordance with one of the preceding embodiments, the mixing element can be received in the film so that the manufacture of a tube for the reception of the mixing element can be omitted. The walls of the mixing element are in this respect surrounded at least partly by an enveloping film. The enveloping film, which is arranged above the mixing element, in particular cooperates with an enveloping film which is arranged beneath the mixing element. The enveloping film is advantageously in each case the same enveloping film which surrounds at least one of the first or second storage regions.

The two enveloping films lie on one another at the two side edges of the mixing element. The two enveloping films contact one another along the support regions here and can be connected to one another at these support regions so that the mixing passage is received in the enveloping films in a fluid-tight manner. The connection can advantageously take place by welding or sealing. Alternatively or in addition hereto, a seam can be provided.

In this respect, a hollow space remains between the mixing element and the enveloping film. If the mixing passage has a circular cross-section, this hollow space is small; it can, however, nevertheless occur that leaks arise on the dispensing of the first and second components. The enveloping film can peel off the wall of the mixing element if a pressure is exerted by the components onto the inner surface of the enveloping film.

Provision can be made in order to increase the mechanical stability of the mixing passage that the mixing element contains at least one protuberance so that the enveloping film lies on the protuberance. The unexpected advantage hereby results that the enveloping film tightly contacts the mixing element, that is in particular contacts the mixing element and also a peeling of the enveloping film from the mixing element can also be avoided under the pressure of the components to be dispensed.

A method for the dispensing of a first component and of a second component from the apparatus in accordance with any one of the preceding embodiments includes the steps:

holding the first storage region and the second storage region using a first holding element;

holding the first discharge passage and the second discharge passage using a second holding element;

moving the first holding element relative to the second holding element along a first rotational direction so that a rotational movement of the first and second storage regions takes place about the kinking site, with the film coming to lie on the parting element;

parting the film by means of the parting element so that the corresponding storage region is connected to the corresponding discharge passage;

exerting a compressive force onto the first storage region and the second storage region;

dispensing the first component from the first storage region into the first discharge passage and simultaneously dispensing the second component from the second storage region into the second discharge passage;

mixing the first component with the second component in the mixing passage to form a mixture;

dispensing the mixture from the mixing passage.

Subsequent to the movement of the first and second storage regions about the kinking site, a movement of the first holding element relative to the second holding element can take place along a rotational direction opposed to the first rotational direction so that a rotational movement of the first and second storage regions takes place about the kinking site such that the film comes to lie on the parting element and the film is parted by means of the parting element.

The holding element can include a hand of a user or a dispensing aid. The dispensing aid serves for the reception of the apparatus. The apparatus is held in the interior of the dispensing aid and the components are dispensed from the apparatus by manipulation of the dispensing aid.

The two storage regions of the apparatus can be tightly connected to one another by the film or the enveloping film, preferably by thermal welding, ultrasonic welding or laser welding. The thermal welding has proved to be a particularly simple and reliable process. For this purpose, deep drawing films, which can be easily welded and which in particular contain polypropylene or polyethylene, are welded together by the pressing together of two oppositely disposed heated stamps of a welding tool.

Figure 2:
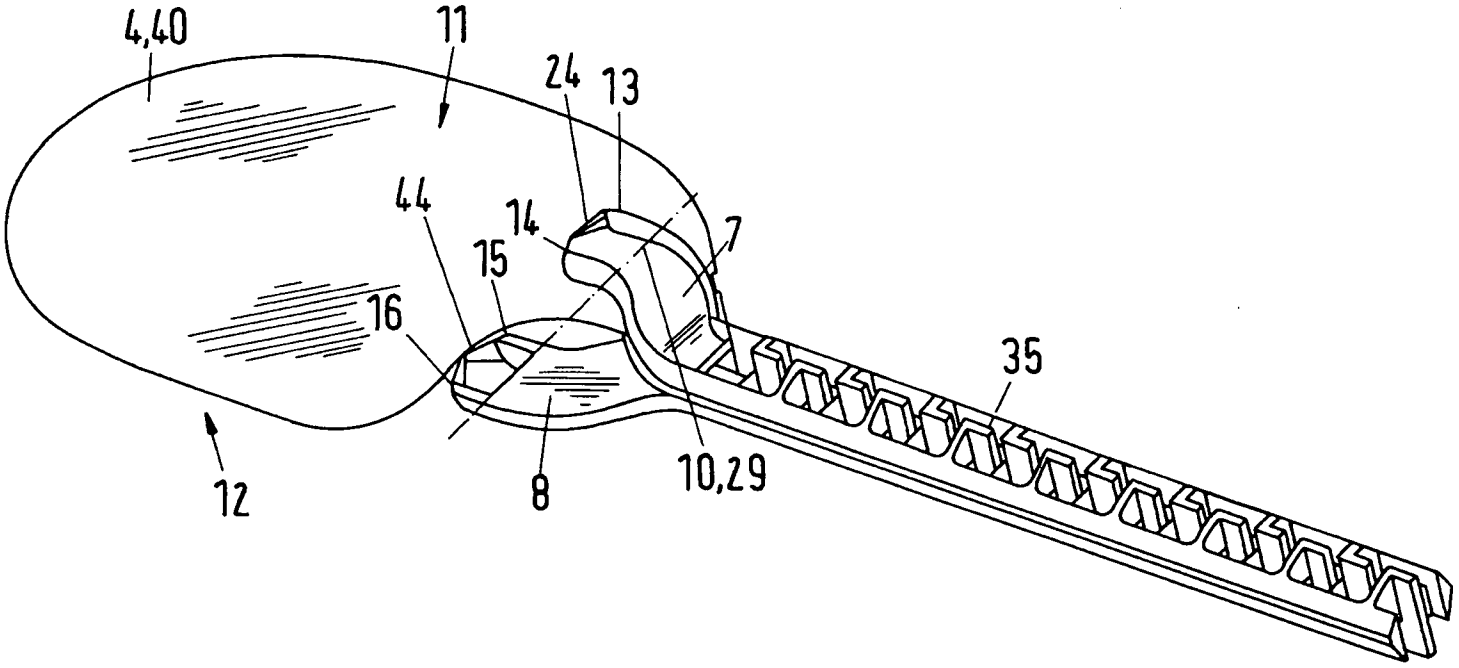
Figure 3:
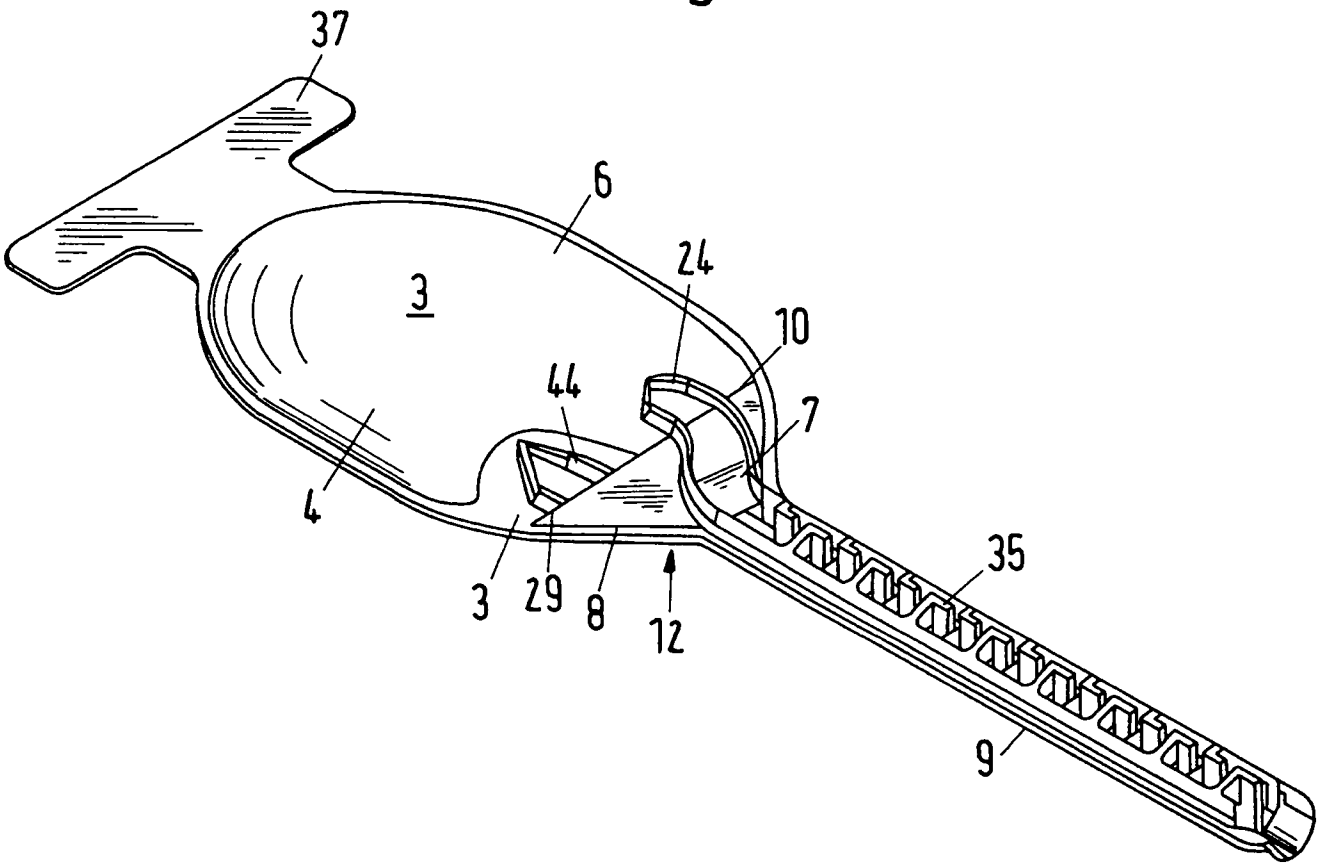
Figure 4A:
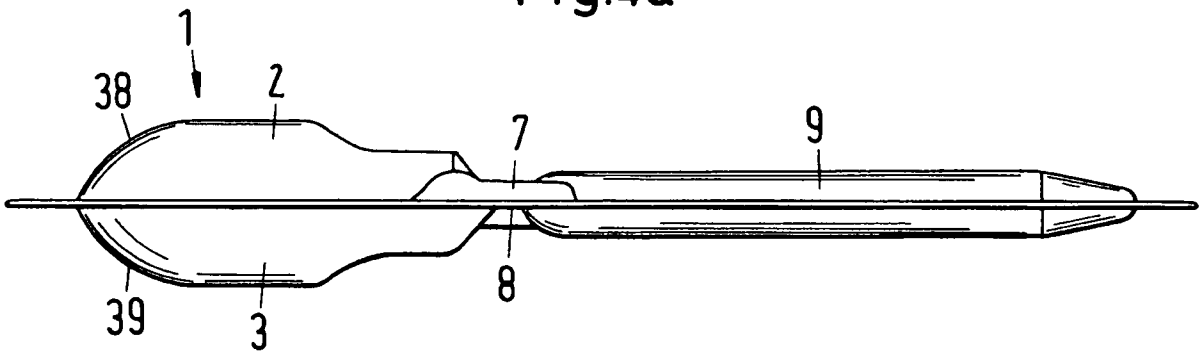
Figure 4B:
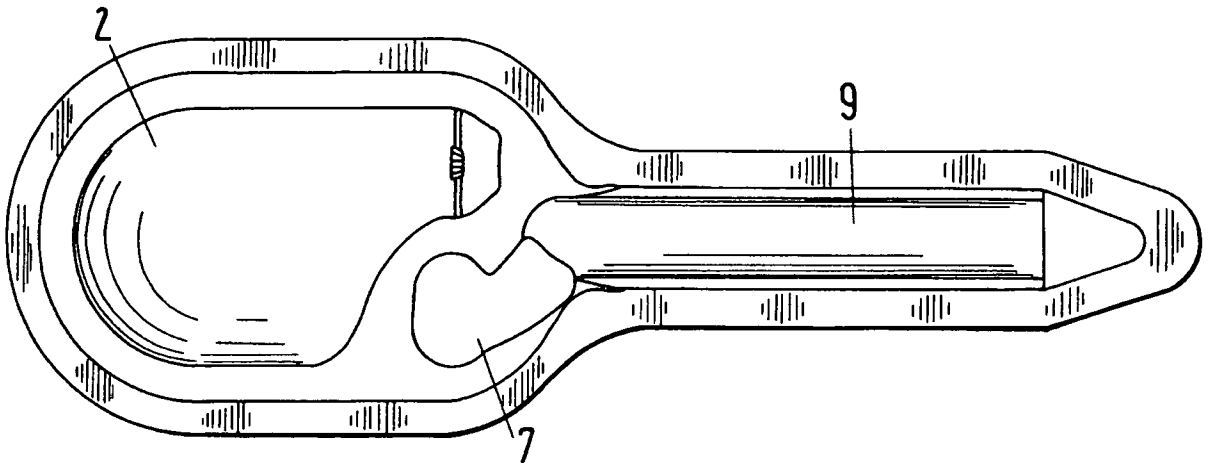
Figure 5:
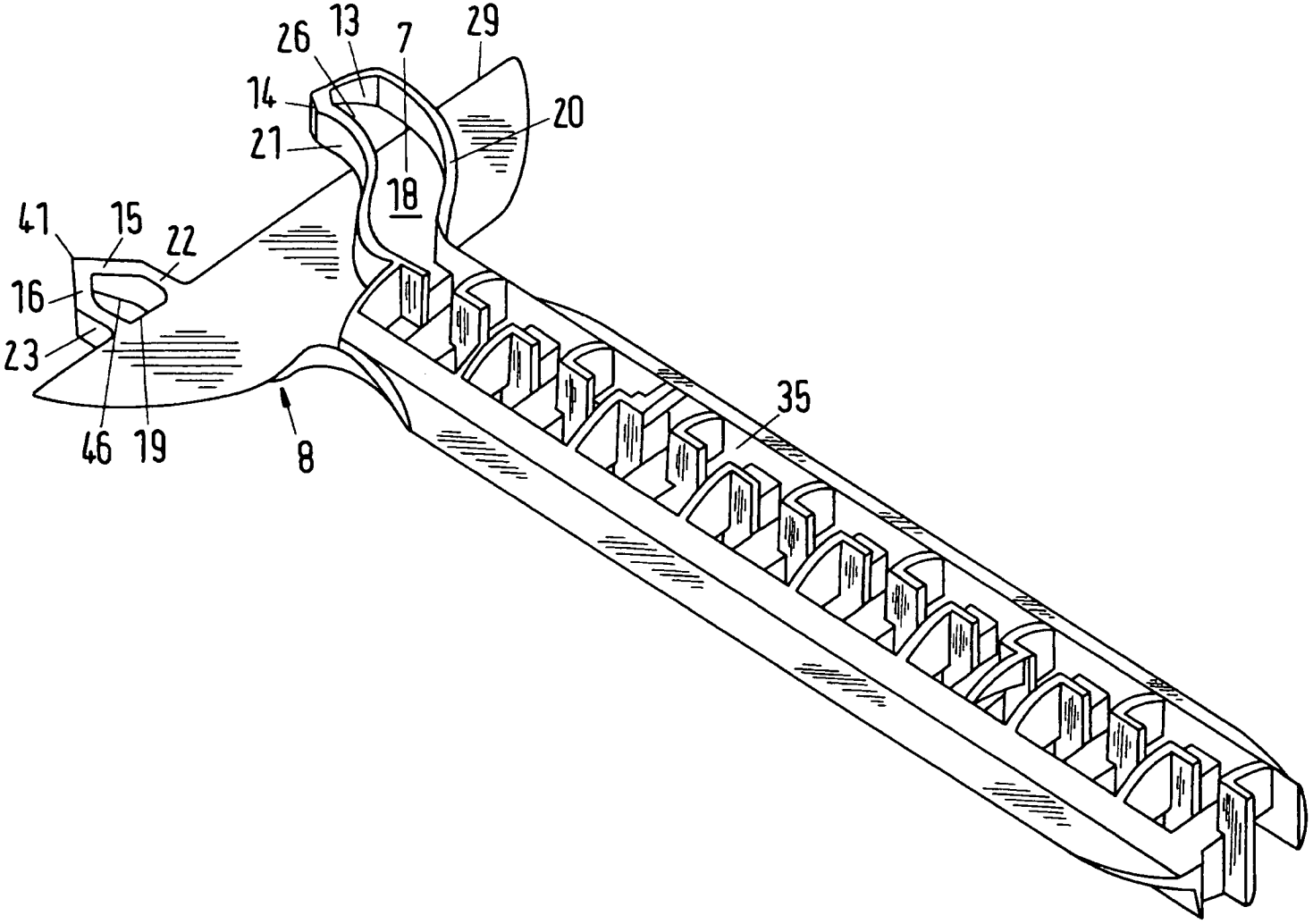
Figure 6:
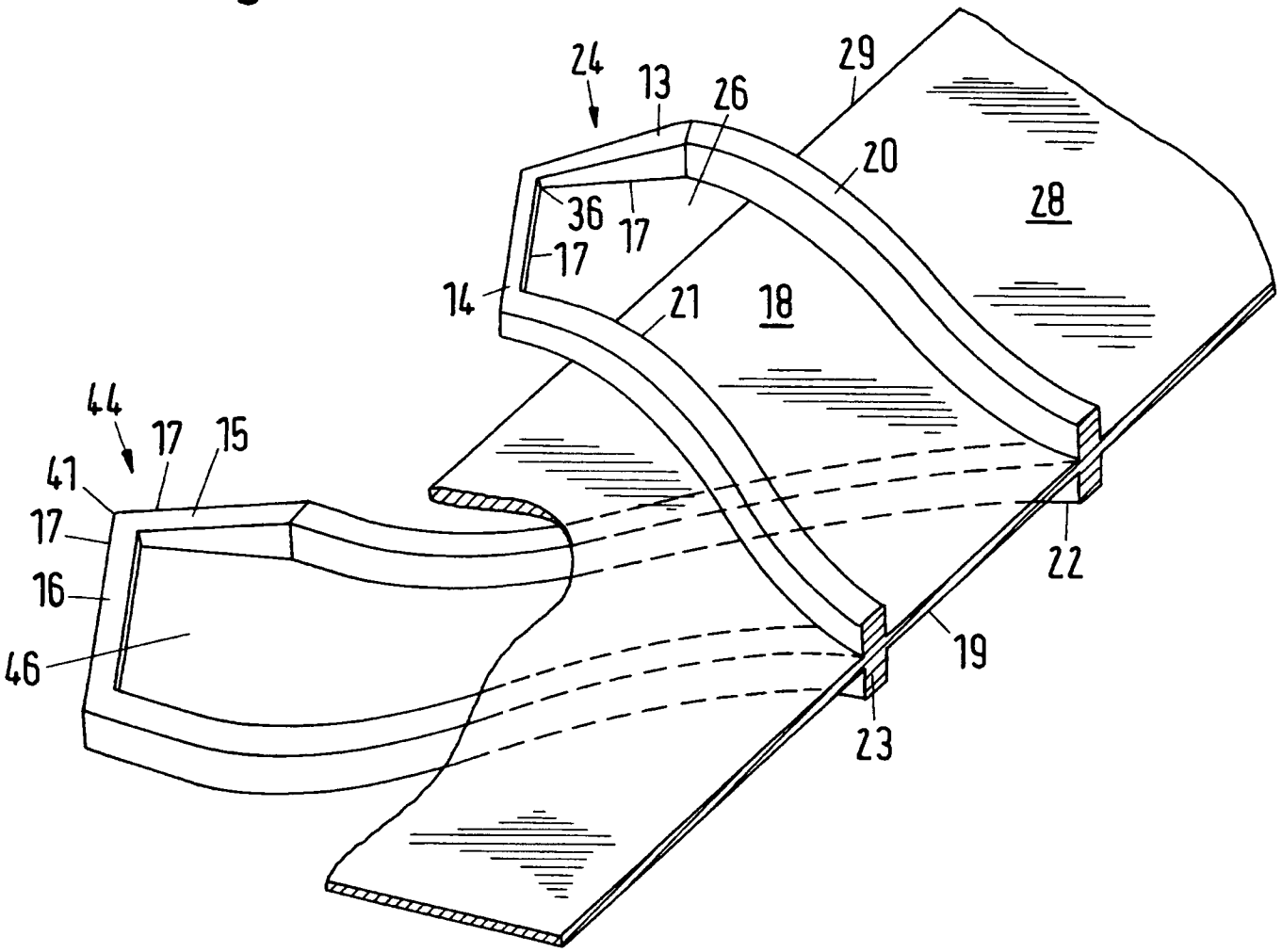
Figure 7:
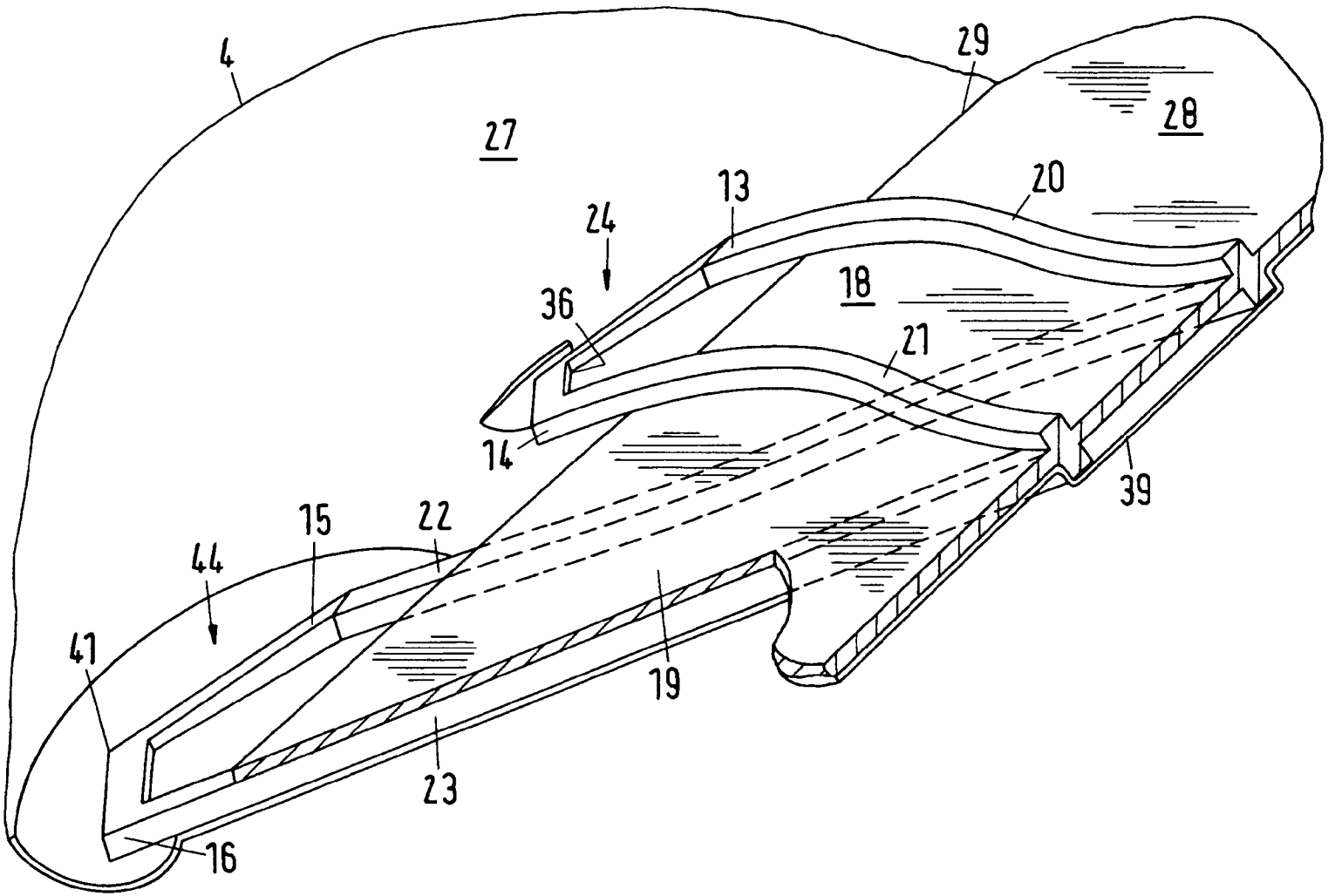
Figure 9:
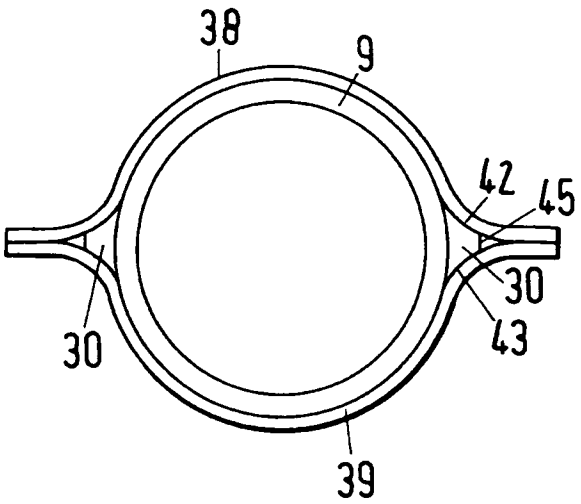
Figure 8:
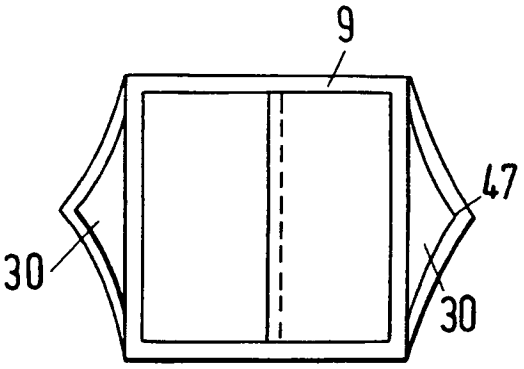

The invention will be explained in the following with reference to the drawings. There are shown:

FIG. 1 a view of a first embodiment of the apparatus in accordance with the invention;

FIG. 2 a view of the apparatus in accordance with FIG. 1, with the walls of the storage regions, the mixing passage and a part of the cover of the discharge passages having been removed;

FIG. 3 the view in accordance with FIG. 2 with the second storage region;

FIG. 4*a* a side view of a second embodiment of the apparatus in accordance with the invention;

FIG. 4*b* a view of the apparatus in accordance with FIG. 4*a* from above;

FIG. 5 a view of an embodiment for a mixing element;

FIG. 6 a detail at the kinking site;

FIG. 7 the detail in accordance with FIG. 6 after carrying out a kinking movement;

FIG. 8 a section through a mixing passage in accordance with a first variant; and FIG. 9 a section through a mixing passage in accordance with a second variant.

Two components can be stored separately and can be dispensed together as required using an apparatus in accordance with the invention for the storage of a plurality of components which are designed for joint use such as is shown in FIGS. 1, 2, and 3 in three views in accordance with a first embodiment. FIG. 1 shows a view of the apparatus 1 from above, with the part of the apparatus 1 which belongs to the first storage region 2 and which is designed for the reception of the first component being shown.

The apparatus includes a first storage region 2 for the reception of a first component 5 and a second storage region 3 for the reception of a second component 6. A broken-away section is shown in the wall of the storage region 2 in FIG. 1 to provide a view of the component 5 hidden behind it. Each of the storage regions 2, 3 can in particular be formed as a half-shell. The first storage region 2 is separated from the second storage region 3 by a film 4 (see FIG. 3) so that a closed chamber is formed between each of the two storage regions and the film. Each of the two storage regions 2, 3 has a support element 31, 32. The support element 31, 32 adjoins the closed chamber. The first storage region 2 and the second storage region 3 can be sealed along the support element while forming a seam 33 and can additionally optionally be connected or welded outside the seam 33 by a connection element 34. The support element 31 and the storage region 2 can be made from an enveloping film 38. The support element 32 and the storage region 3 can be made from an enveloping film 39.

It may be necessary for particularly reactive components to provide a special lining or coating at the inner wall of the corresponding storage region 2, 3.

FIG. 2 shows a view of the apparatus for which the walls of the storage region 2, 3, the mixing passage 9 and a part of the first and second discharge passages 7, 8 have been removed. In this view, the film 4 has been partly omitted so that the extent of the second discharge passage 8 up to the entry into the mixing passage 9 becomes visible which is provided downstream of the discharge passages 7, 8. The mixing passage 9 contains a mixing element 35. A kinking site 10 is arranged between the first and second storage regions 2, 3 and the first and second discharge passages 7, 8.

The first storage region 2 and the first discharge passage 7 are arranged on the first side 11 of the film 4, the second storage region 3 and the second discharge passage 8 are arranged on the second side 12 of the film 4. The first side 11 is arranged disposed opposite the second side 12.

At least one of the discharge passages 7, 8 has an arm 13, 14, 15, 16 which extends beyond the kinking site 10 in the direction of the storage region 2, 3 associated with the corresponding discharge passage 7, 8. Two respective adjacent arms, which belong to a discharge passage, are connected to one another. In accordance with FIG. 2, the arm 13 is connected to the arm 14, with the two arms 13 and 14 belonging to the discharge passage 7. Furthermore, the arm 15 is connected to the arm 16, with the two arms 15 and 16 belonging to the discharge passage 8. Two arms each form a parting element 24, 44.

FIG. 3 shows the view of the second storage region 3, with the first storage region 2 being omitted, as in FIG. 2. FIG. 3 thus shows the part of the apparatus 1 which is located on the side 12 as well as additionally the first discharge passage 7. The film 4 is omitted in FIG. 3 so that the second storage region 3 can be seen better.

A web 37 is arranged at the end of the storage region which is disposed opposite the mixing passage 9 for the embodiment in accordance with FIGS. 1 and 3. This web 37 can be held in a dispensing aid by a first holding element. The dispensing aid is not shown here. An example for such a dispensing aid can be found in WO2006/079413.

FIG. 4*a* shows a further embodiment of the apparatus in accordance with the invention. Parts with the same effect have the same reference numerals as in FIGS. 1 to 3 and will no longer be described in detail to the extent their function does not differ from the first embodiment. In this embodiment, for example, the web 37 is missing so that this variant is in particular suitable for the manual dispensing of the filling material which is located within the first or second storage regions.

It is shown in FIG. 4*a* that the mixing passage 9 as well as the two storage regions 2, 3 are surrounded by a first and a second enveloping film 38, 39 which serves for the reception of the components and for the reception of the mixing element 35. The following description can naturally also apply to the first embodiment.

For the manufacture of an apparatus in accordance with any one of the preceding embodiments, a first enveloping film 38 is placed onto a support or mold which has a cut-out in the shape of the first storage region 2 and a cut-out for the first discharge passage 7 and for the mixing passage 9. The enveloping film is placed onto the support such that it lies on the support in all cut-outs. The cut-out for the first storage region 2 is not connected to the cut-out for the first discharge passage 7 or the mixing passage 9. The cut-out of the second storage region 2 can therefore be filled with the first component 5. If the storage region 2 is filled with the first component 5, the first storage region 2 is covered by a film 4 and is closed in a fluid-tight manner. The component 5 is thus enclosed in the storage region 2.

Subsequently, a second enveloping film 39 is placed onto a support which has a cut-out in the form of the second storage region 3 as well as a cut-out for the second discharge passage 8 and for the mixing passage 9. The enveloping film 39 is placed onto the support or mold such that it lies in all cut-outs on the support. The cut-out for the second storage region 3 is not connected to the cut-out for the first discharge passage 7 or the mixing passage 9. The cut-out of the second storage region 3 can therefore be filled with the second component 6. If the second storage region 3 is filled with the second component 6, the second storage region 3 can also be covered by a film 40 and can be connected thereto in a fluid-tight manner. The component 6 is thus enclosed in the storage region 3. However, under certain circumstances, the application of the film 40 can also be dispensed with in this case, as will be explained in the following.

In a next step, the mixing element 35 is placed into the cut-out for the mixing passage 9 and the second discharge passage 8 is placed into the corresponding cut-out. The mixing element 35 is advantageously connected in one part to the first and second discharge passages 8, 9 so that an alignment of the parts with respect to one another is not needed. The second storage region does not necessarily have to be closed by a film 40 in this case since in a following workstep the first enveloping film 38 is placed together with the first storage region 2 in which the first component 5 is enclosed onto the second enveloping film 39, the second component 6 and the mixing element. The two components are thus separated from one another.

The first enveloping film 38 and the second enveloping film 39 are connected to one another along the contact surfaces, that is of the part of the corresponding enveloping film which does not have any cut-out, so that, on the one hand, the second component 3 is enclosed in its storage region 3 and also the mixing element 35 is also enclosed together with the first and second discharge passages 7, 8 in the first and second enveloping films 38, 39.

In an intermediate step, a further film 40 can be placed onto the second storage region and the second storage region 3 can thus likewise be closed by this film 40. This variant is advantageous if delays occur in the assembly of the apparatus and/or if the second component may not be exposed to the air or is sensitive to light or there is the risk that the second component enters into the discharge passage or even the mixing element.

It should be stated in detail in the following how the two components 5, 6 enclosed in their storage regions 2, 3 can be dispensed simultaneously and can be mixed.

In FIG. 5, the mixing element 35 and the corresponding discharge passages 7, 8 are shown in detail. The mixing element 35 and the discharge passages 7, 8 are designed as a single component which is advantageously manufactured in an injection molding process. Each of the discharge passages is made up of a base 18, 19 as well as of a respective first side wall 20, 22 and second side wall 21, 23.

The base 18, as well as the base 19, of which only an edge is visible, can merge into a plate-like element 41. The first and second discharge passages 7, 8 form the base 18, 19. The base has an end 29 facing the corresponding storage region 2, 3, with the kinking site 10 being formed by the end 29 of the base.

Each of the arms 13, 14, 15, 16 can have a cutting edge 17 which faces the film 4 for this purpose and which is shown in FIG. 6 or FIG. 7. FIG. 6 and FIG. 7 thus show a detail of the apparatus shown in FIGS. 1-3 or FIG. 4*a* or FIG. 4*b* in the region of the kinking site 10.

The discharge passage 7, 8 includes a base 18, 19 on which the film 4 extends as well as a first wall 20 and a second wall 21, with the arm 13, 14, 15, 16 being separated from the base 18, 19 by the film 4.

Referring to FIG. 6, each of the arms 13, 14, 15, 16 is formed by at least one prolongation of the first or second walls 20, 21, 22, 23. The parting element 24, 44 includes a respective first and second arm 13, 14, 15, 16 which extends from the kinking site 10 in the direction of the corresponding storage regions 2, 3.

Alternatively, the respective base 18, 19 of the corresponding discharge passage 8, 9 can open into a parting element 24, 44, which is not shown graphically. At least one of each of the first and second arms 13, 14, 15, 16 are arranged adjacent to one another and form a tip 36 at which a cutting edge 17 facing the film 4 is arranged.

The parting element 24 which belongs to the first discharge passage 7 contains a cut-out 26. The parting element 44 which belongs to the second discharge passage 8 contains a cut-out 46. The cut-out 26 is surrounded by the tip 36, by the corresponding first and second arm 13, 14 and by the base 18 of the first discharge passage 7. The cut-out 46 is surrounded by the tip 41, by the corresponding first and second arm 15, 16 and by the base 19 of the second discharge passage 8.

The corresponding discharge passage 7, 8 has a respective first and second wall 20, 21, 22, 23 which extends from the base 18, 19, with at least one of the arms 13, 14, 15, 16 adjoining the corresponding first or second wall 20, 21, 22. 23. Two each of the adjacent arms run together in the corresponding tip 36, 41 which has a sharp edge on the side facing the film 4. Supplementary to this, the arms can also have sharp edges on the side facing the film 4.

The surface disposed opposite the tip 36, 41 preferably has a rounded portion. If one of the enveloping films 38, 39 comes to lie on this rounded portion, it remains intact even if an external pressure force acts on the enveloping film. It is thus prevented by the rounded portion that the enveloping film is damaged when it is loaded from the outside, for example if a plurality of apparatus are stacked over one another or if pressure is accidentally exerted onto the storage region in the proximity of the corresponding discharge passage on dispensing.

The film 4 can be parted on the first side 11 by means of the parting element 34 when the angle between a film 4 closing the storage regions 2, 3 and the base 18 of the first discharge passage 7 is less than 180°.

The film 4 can be parted on the second side 12 by means of the parting element 44 when the angle between a film 4 closing the storage regions 2, 3 and the base 19 of the second discharge passage 8 is greater than 180°.

A section through the mixing passage 9 of a first variant is shown in FIG. 8. The mixing passage contains a mixing element 35 which is received in the enveloping films 38, 39.

The mixing element 35 advantageously has at least one longitudinally extending protuberance 30 so that the enveloping film 38, 39 lies on the protuberance 30. The protuberance 30 can be shaped at oppositely disposed sides of the outer wall of the mixing element 35. The shape of the protuberance 30 is such that the enveloping films 38, 39 contact the protuberance 30 as tightly as possible in each case so that no hollow spaces arise between the enveloping films 38, 39 and the mixing element 35. The mixing element preferably has a quadrangular cross-section, in particular a square cross-section.

FIG. 9 shows a section through a mixing passage 9 in accordance with a second variant. Unlike the embodiment in accordance with FIG. 8, this mixing passage 9 and the mixing element 35 arranged in the mixing passage have a circular cross-section. The protuberance 30 has two surface pieces with a concave curvature 42, 43 and a surface piece arranged between these two surface pieces and having a preferably planar surface 45. Alternatively to this, the two surface pieces 42, 43 could also be planar or have a convex curvature. In any case, the tip shown in FIG. 8 is flattened and forms the planar surface 45. The surface 45 could naturally also have a weak curvature or inclination. The two enveloping films 38 and 39 sealingly contact the surface pieces 42, 43 and the surface 45 and are connected to one another directly adjoining the surface 45, preferably by a sealing or welding or by a combination of these processes. Alternatively or in addition hereto, a seam can be provided.

The apparatus in accordance with any one of the preceding embodiments is in particular suitable for the separate storage and the joint dispensing of multi-component adhesives or multi-component sealing materials. Mold compositions for applications in the dental area or filling materials represent a further application.

Referring to FIG. 7, if the two first and second components 5, 6 located in the first and second storage regions 2, 3 should be dispensed from an apparatus, the following steps are necessary:

holding a first end 27 containing the first and second storage regions 2, 3 using a first holding element;

holding a second end 28 containing at least one of the first and second discharge passages 7, 8 using a second holding element;

moving the first holding element relative to the second holding element in a first rotational direction so that a rotational movement of the first end 27 takes place about the kinking site, with the film 4 coming to lie on the arm 13, 14, 15, 16;

parting the film 4 by means of the arm 13, 14, 15, 16 so that the corresponding storage region 2, 3 is connected to the corresponding discharge passage 7, 8;

exerting a compressive force onto the first storage region 2 and the second storage region 3;

dispensing the first component 5 from the first storage region 2 into the first discharge passage 7 and simultaneously dispensing the second component 6 from the second storage region 3 into the second discharge passage 8;

mixing the first component 5 with the second component 6 in the mixing passage 9 to form a mixture; and dispensing the mixture from the mixing passage 9.

Subsequent to the movement of the first and second storage regions 2, 3 about the kinking site 10, a movement of the first holding element takes place relative to the second holding element along a rotational direction opposed to the first rotational direction so that a rotational movement of the first and second storage regions 2, 3 takes place about the kinking site 10 such that the film 4 comes to lie on the parting element 24. The film 4 is thus parted by means of the parting element 24.

The holding element can in particular be the hand of a user who wants to dispense the two components from the apparatus to supply them to a desired application.

The invention thus provides a cost-effective apparatus for the storage and metering of a plurality of components which is simple to operate and which can be reliably opened by a simple movement while using small opening forces.

What is claimed is:

1. An apparatus comprising a first storage region for the reception of a first component;

a second storage region for the reception of a second component, said second storage region being disposed opposite said first storage region;

a film between said first storage region and said second storage region for separating the first component from the second component;

a first discharge passage for communicating with said first storage region;

a second discharge passage for communicating with said second storage region;

a common mixing passage in communication with each of said first discharge passage and said second discharge passage;

a line-shaped kinking site arranged between said first and second storage regions and said first and second discharge passages;

a parting element extending from at least one of said first discharge passage and said second discharge passage, said parting element extending beyond said kinking site in a direction of a respective one of said first storage region and said second storage region, said parting element including a pair of arms extending from said kinking site in a direction of a respective one of said first storage region and said second storage region wherein at least one of said pair of arms forms a tip having a cutting edge facing said film.

2. An apparatus in accordance with claim 1 wherein said first storage region and said first discharge passage are arranged on a first side of said film and said second storage region and said second discharge passage are arranged on a second side of said film.

3. An apparatus in accordance with claim 1 wherein at least one of said first discharge passage and said second discharge passage has a base including an end facing a respective one of said first storage region and said second storage region with said kinking site being formed by said end of said base.

4. An apparatus in accordance with claim 1 wherein said parting element contains a cut-out for passage of a respective one of the first component and the second component.

5. An apparatus in accordance with claim 1 wherein said pair of arms and said tip define a cut-out for passage of a respective one of the first component and the second component.

6. An apparatus in accordance with claim 1 wherein said one of said pair of arms forming a tip has a rounded surface disposed on a side opposite said tip.

7. An apparatus in accordance with claim 1 wherein said at least one of said first discharge passage and said second discharge passage has a base including an end forming said kinking site and a pair of walls extending from said base, each said wall of said pair of walls adjoining with a respective one of said arms of said pair of arms.

8. An apparatus in accordance with claim 1 wherein at least one of said first discharge passage and said second discharge passage has a base including an end facing a respective one of said first storage region and said second storage region with said kinking site being formed by said end of said base and wherein said parting element is arranged to part said film on a first side when the angle between said film and said base is less than 180°.

9. An apparatus in accordance with claim 1 further comprising a base between said first discharge passage and said second discharge passage having an end defining said kinking site, wherein said parting element is a first parting element extending from said first discharge passage beyond said kinking site and a second parting element extends from said second discharge passage beyond said kinking site, whereby said first parting element is arranged to part said film on a first side when the angle between said film and said base is less than 180° and said second parting element is arranged to part said film on a second side when the angle between said film and said base is greater than 180°.

10. An apparatus in accordance with claim 1 further comprising a mixing element in said mixing passage.

11. An apparatus in accordance with claim 10 further comprising an enveloping film defining said first storage region, said second storage region, said first discharge passage, said second discharge passage and said common mixing passage.

12. An apparatus in accordance with claim 11 wherein said mixing element has at least one longitudinally extending protuberance in contact with said enveloping film.

* * * * *